US010670193B2

(12) United States Patent
Lin et al.

(10) Patent No.: US 10,670,193 B2
(45) Date of Patent: Jun. 2, 2020

(54) METHOD OF INSTALLING LED LIGHT BAR, BULB APPARATUS AND LIGHT APPARATUS

(71) Applicant: XIAMEN ECO LIGHTING CO. LTD., Xiamen (CN)

(72) Inventors: Yunnan Lin, Xiamen (CN); Chen Li, Xiamen (CN); Lilei Su, Xiamen (CN); Xianghua Lin, Xiamen (CN); Xiaobo Chen, Xiamen (CN); Liangliang Cao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/471,824

(22) Filed: Mar. 28, 2017

(65) Prior Publication Data

US 2018/0238499 A1 Aug. 23, 2018

(30) Foreign Application Priority Data

Feb. 21, 2017 (CN) ..... 2017 1 0092304

(51) Int. Cl.

| | |
|---|---|
| ***F21V 21/00*** | (2006.01) |
| ***F21K 9/232*** | (2016.01) |
| ***F21K 9/90*** | (2016.01) |
| *F21K 9/238* | (2016.01) |
| *F21V 23/00* | (2015.01) |
| *F21Y 105/10* | (2016.01) |
| *F21Y 115/10* | (2016.01) |

(52) U.S. Cl.

CPC ..... *F21K 9/232* (2016.08); *F21K 9/90* (2013.01); *F21K 9/238* (2016.08); *F21V 23/003* (2013.01); *F21Y 2105/10* (2016.08); *F21Y 2115/10* (2016.08)

(58) Field of Classification Search

CPC . F21K 9/232; F21K 9/238; F21K 9/90; F21V 29/503; F21V 23/003; F21Y 2105/10; F21Y 2115/10

USPC ..... 362/249.07

See application file for complete search history.

(56) References Cited

U.S. PATENT DOCUMENTS

| | | | | |
|---|---|---|---|---|
| 9,803,848 | B2 * | 10/2017 | Van Hout | F21V 3/061 |
| 9,863,624 | B2 * | 1/2018 | Rao | F21V 29/503 |
| 2009/0026982 | A1 * | 1/2009 | Lee | H05B 33/0803 315/312 |
| 2012/0169251 | A1 * | 7/2012 | Lai | F21K 9/90 315/294 |
| 2012/0170288 | A1 * | 7/2012 | Lai | F21K 9/90 362/373 |

(Continued)

*Primary Examiner* — Laura K Tso

(74) *Attorney, Agent, or Firm* — Chun-Ming Shih; LanWay IPR Services

(57) ABSTRACT

A method of installing a light emitting diode light bar into a bulb is provided. Place the light bar module into the light bulb shell. The light bar module has a plurality of light emitting diode light bars and an expansion structure. The expansion structure is not expanded and is disposed among multiple light emitting diode light bars. Each light emitting diode light bar has a certain degree of flexibility. Expanding the expansion structure then, therefore multiple light emitting diode light bars are individually bent and deformed toward the bulb shell direction. Next, remove the expansion module and install other components of the bulb.

6 Claims, 8 Drawing Sheets

(56) References Cited

U.S. PATENT DOCUMENTS

2014/0268771 A1* 9/2014 Heikman ..... F21V 29/004
362/249.02

* cited by examiner

METHOD OF INSTALLING LED LIGHT BAR, BULB APPARATUS AND LIGHT APPARATUS

TECHNICAL FIELD

The present invention relates to a method of installing a LED light bar, a bulb apparatus and a light apparatus, and particularly to a method of installing a light emitting diode light bar in a bulb, a bulb apparatus and a light apparatus.

BACKGROUND

Lighting is an important part of human life, and it plays an increasingly important role. With the evolution and development of technology, light emitting diode technology has been widely applied to daily used light apparatus. The lighting efficiency of a light emitting diode is usually higher than that of a conventional tungsten or fluorescent lamp. Also, with the continuous improvement of manufacturing technology, the manufacturing costs of the light emitting diodes continue to decrease. This encourages more people to develop more light emitting diode light apparatus.

On the other hand, although the lighting efficiency of light emitting diodes is quite high, a certain amount of heat may be generated either by the driving circuit or by the light emitting diode itself, when operated continuously.

If the heat is not effectively dissipated, the service life of the light apparatus itself is often affected.

In addition, the substantial lighting efficiency of the entire light apparatus is affected by improving the position and the angle of the light emitting diodes effectively.

Therefore, the continuous development of the light emitting diodes is always a very valuable work.

SUMMARY OF THE INVENTION

According to a first embodiment of the present invention, a method of installing a light emitting diode light bar in a bulb is provided. First, the light bar module is placed into the bulb shell, wherein the light bar module includes a plurality of light emitting diode light bars and an expansion structure. The expansion structure is unexpanded and is disposed on the backside of multiple light emitting diode light bars, wherein each light emitting diode light bar has certain flexibility.

Then, to expand the expansion structure so that multiple light emitting diode light bars is individually bent and deformed toward the bulb shell direction. And, to shrink the expansion structure after the light emitting diode light bars are bent and deformed. Next, the expansion structure is removed from the light bars module. After that, the other components of the bulb are installed.

By utilizing this method, even if the bulb shell inlet is relatively narrow, light bars are still installed into the bulb shell smoothly and effectively. In addition, after the light bars are placed into the bulb, the light bars are expanded and moved to a desired position. Because the light bars include light emitting diode dies on their top portions. The change of angle of the light bars and their positions inside the bulb shell both directly affect the beam angles of the light emitting diode dies. By utilizing such an installation method, one may accurately and easily design the location for the light bars to be expanded. Furthermore, the light emitting diode dies may be placed in the desired location according to different design requirements, so as to enhance the overall lighting efficiency and lighting effects.

According to one embodiment, the expansion structure may be an airbag. To inflate the airbag, the expansion structure is expanded. To deflate the airbag, the expansion structure is shrined.

In addition, according to one embodiment, each of the light emitting diode light bars includes two or more light bar sections. A segmented portion is further included between the light bar sections. When the expansion structure abuts the light bar module so as to bend and deform the light emitting diode light bars, the light emitting diode light bars are bent in the segmented portion.

For example, the light bar may be divided into two sections, and a structure that is relatively easy to bend is provided between the two sections. Alternatively, suitable light emitting diode dies may be disposed on the two sections, and no structure is provided at the junction of the two sections. When the substrate itself is resilient, for example, aluminum is used as a material; applying a bending force to the light bars may naturally bend the substrate at the junction of the two sections.

In addition, in one embodiment, the segmented portion retains its original shape when no force applied, by designated materials or structures. In other words, if the segment is originally flat, the flat state remains when no force applied. However, if the segmented portion is bent by an external force, it remains in a bent state when the external force is in contact and does not continue to undertake other forces.

In one embodiment, the light emitting diode light bars include a flexible circuit board as substrate. The substrate is bendable when undertaking a certain external force, while the substrate remains the shape when the external force is removed.

In one embodiment, adhesives are applied to a predetermined location of the light emitting diode light bars. When the light emitting diode light bars are abutted by the expansion structure, the light emitting diode light bars are expanded and in touch with the bulb shell. At the time, the adhesives stick to the bulb shell, so as to generate a certain fixing effect between the light-emitting diode light bars and the bulb shell. In other words, the light bars are partially or completely attached to the bulb shell. By doing this, not only the lighting efficiency is higher, the relative distance of the light emitting dies is also farther, so as to avoid the heat dissipation issues or allowing more light emitting dies or other more efficient light emitting dies to be included.

In one embodiment, a corresponding snap structure may be formed on the inner side of the bulb shell and the light emitting diode light bars. When the inner side of the bulb shell is in contact with the light emitting diode light bars, the inner side of the bulb shell is engaged with the light emitting diode light bars through the corresponding snap structure. This is an alternative way to adhesives.

In addition, the method may further include a step of connecting the light bar module with a driving circuit.

In addition, multiple light emitting diode light bars of the light bar module may be designed to be connected at the top portions. This design makes it easier to install the light bar module into the bulb shell.

In one embodiment, the method may further include a step of placing a heat dissipation element on the back of the light emitting diode light bars facing the bulb shell. For example, a thermal conductive plate may be placed, so as to transmit a part of the heat to other portions of the bulb to dissipate. A cooling fin or other designs, such as a liquid cooling circulation tube, may also be disposed in the bulb in order to dissipate heat.

In one embodiment, more than one light emitting modules are installed into the bulb shell. In other words, this method may include another step of installing another light emitting module into the bulb shell. The other light emitting module is surrounded by multiple light emitting diode light bars. According to another embodiment of the present invention, a bulb device including a bulb shell, a light bar module, a driving circuit and a bulb cap is provided. The light bar module is installed in the bulb shell. The light bar module has a plurality of light emitting diode light bars. These light emitting diode light bars are individually expanded toward the inner edge of the bulb shell. A driving circuit is connected to the light bar module. The bulb cap includes two electrical connection terminals for connecting external power to the driving circuit, so as to allow the driving circuit to drive the light bar module to generate illumination.

In one embodiment, at least a portion of multiple light emitting diode light bars contacts the bulb shell. In addition, in another embodiment, the light emitting diode light bar includes two or more light bar sections. A segmented portion is provided between the light bar sections. When multiple light emitting diode light bars is expanded outward by an expansion structure, multiple light emitting diode light bars are individually expanded toward the inner edge of the bulb shell. When the expansion force is removed, multiple light emitting diode light bars continuing to maintain their original shapes. The substrate of each of the light emitting diode light bars may be a flexible circuit board, which may be bent when subjected to a certain external force, but continues to retain the shape after the external force is removed. The light emitting diode light bars may include adhesives at a predetermined location. The light emitting diode light bars and the bulb shell are fixed through the adhesives. A corresponding snap structure may be further included on the bulb shell and the light emitting diode light bars. So the bulb shell and the light emitting diode light bars are engaged through the corresponding snap structure.

In addition, multiple light emitting diode light bars of the light bar module may be connected together at their top portion. A heat dissipation element may be further disposed on the back of the light emitting diode light bars, relative to the bulb shell. The bulb device may further include another light emitting module located among multiple light emitting diode light bars. The light bar module may include two or more sub-light bar modules, each having a plurality of light emitting diode light bars.

According to another embodiment of the present invention, a light apparatus including a light transmitting shell, a light bar module, and a power supply circuit is provided. The light bar module is installed inside the light transmitting shell. The light bar module includes a plurality of light emitting diode light bars, wherein at least a portion of the light emitting diode light bars abuts the light transmitting bulb shell. The power supply circuit connects to the light bar module, and supplies electric power required for the light bar module. In other words, in addition to the bulb hanging on the ceiling, this design concept may also be used in a variety of general lighting with different shapes. The light emitting diode light bars may be partially or completely attached to the light transmitting bulb shell through the above method, so as to further increase the heat dispensation and lighting efficiency. The light transmitting bulb shell may be in a variety of different shapes. The power supply circuit may also be a battery, and is not necessarily connected to an internal power supply.

In addition, the light emitting diode light bar may have two or more light bar sections. A segmented portion is provided between the light bar sections. When the light emitting diode light bars are abutted by an expansion structure and expand outwards, they may be individually deformed and expanded toward the inner edge of the light transmitting bulb shell. When the expansion force is removed, multiple light emitting diode light bars continues to maintain the shape at that time.

In addition, the substrates of each of the light emitting diode light bars may be flexible circuit boards. It may be bent when undertake a certain external force, but continue to retain the shape after the external force is removed. In addition, the light emitting diode light bars may include adhesives at a predetermined position, so as to generate a certain fixing effect between the light emitting diode light bars and the light transmitting bulb shell. In addition, the light apparatus may have a snap structure corresponding to the light transmitting bulb shell and the light emitting diode light bars, so as to snap the light transmitting bulb shell and the light emitting diode light bars. In addition, multiple light emitting diode light bars of the light bar module may be designed to be connected together at their top portions. A heat dissipation element may be further included on the back of the light emitting diode light bars, relative to the bulb shell.

DETAILED DESCRIPTION

Figure 7:
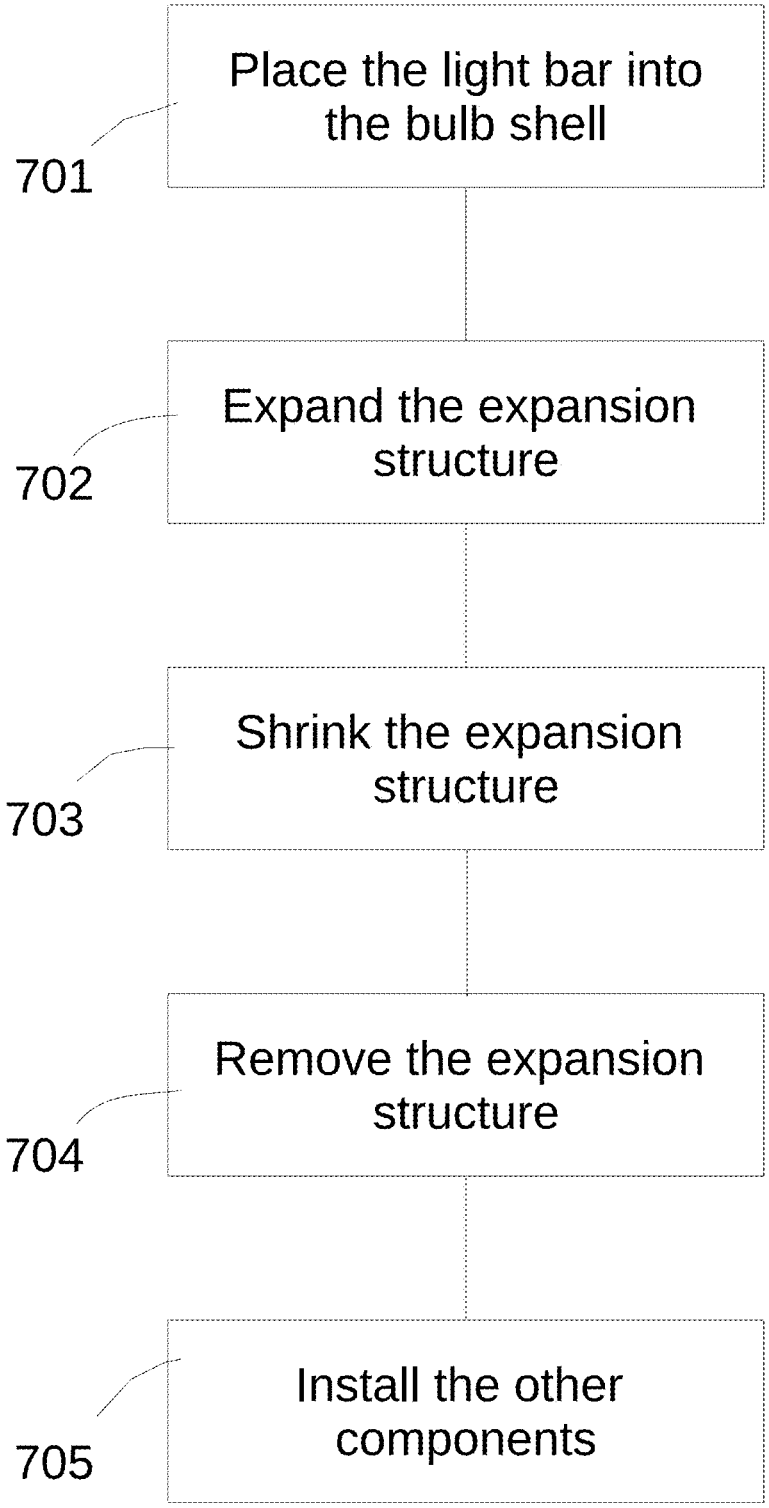
FIG. 7 illustrates a flow chart of a method for assembling a bulb.

First, please refer to FIG. 7. FIG. 7 illustrates a first embodiment according to the invention concerning a flow chart of a method for assembling a bulb. This method may be used for installing light emitting diode light bars into a bulb. First, a light bar module is placed into the bulb shell (step 701), wherein the light bar module includes a plurality of light emitting diode light bars and an expansion structure. The expansion structure is not expanded and is disposed on the backside of multiple light emitting diode light bars, wherein each light emitting diode light bar includes a certain bending property.

Then, the expansion structure is expanded (step 702) so that multiple light emitting diode light bars are individually bent and deformed toward the bulb shell direction. The expansion structure is shrunken after the light emitting diode light bars are bent and deformed (step 703). Next, the expansion structure is moved away from the light bar module (step 704). Then, install other components of the bulb (step 705).

By utilizing this method, even if the bulb shell inlet is relatively narrow, light bars are still installed into the bulb shell smoothly and effectively. In addition, after the light bar is placed into the bulb, the light bar is expanded and moved to a desired position.

Because the light bar includes light emitting diode dies on its top portion. The change of angle of the light bar and its position inside the bulb shell both directly affect the beam angle of the light emitting diode dies. By utilizing such an installation method, one may accurately and easily design the location for the light bar to expand. Furthermore, the light emitting diode dies may be placed in the desired location according to different design requirements, so as to enhance the overall lighting efficiency and lighting effects.

Figure 6A:
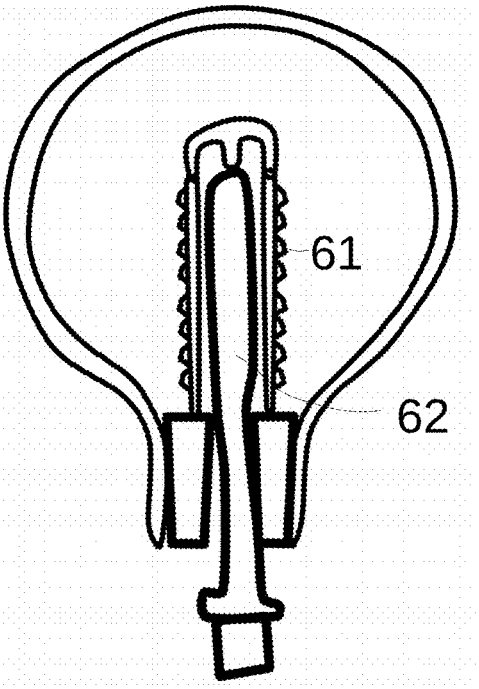
FIG. 6A and FIG. 6B illustrate embodiments utilizing different expansion structures.
Figure 6B:
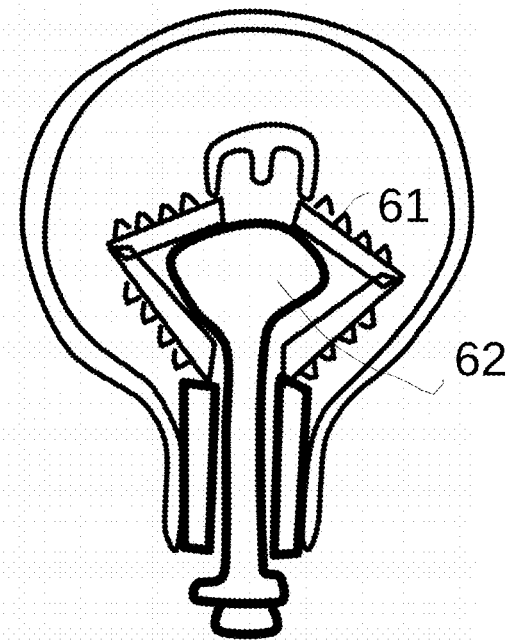

Please refer to FIG. 6A and FIG. 6B which illustrate embodiments utilizing an airbag as the expansion structure. In the embodiment, the expansion structure is an airbag 62. To inflate the airbag 62, the expansion structure is expanded so as to deform the corresponding light bar module 61. To deflate the airbag 62 after the deformation of the light bar module 61 is completed, so as to shrink the expansion structure. It is noted that the purpose of the expansion structure is to allow the corresponding light bar module to bend and change its original form correspondingly, after it is placed into the bulb shell. In other words, even if the expansion structure itself is not actually expanded in volume, it should be interpreted as expansion structure, as long as the bulb module generates a morphological change in expansion. For example, in the following embodiment, an insert tube having constant volume is still regarded as an implementation type of the expansion structure, as long as the morphological change in expansion of the light bar module is induced. As for the expansion and shrinkage of the expansion structure mentioned herein, it may be interpreted that the expansion structure is expanding the morphology of the corresponding light bar module, or is finishing the expansion the light bar module and in the state of leaving the bulb shell from the light bar module.

Figure 1:
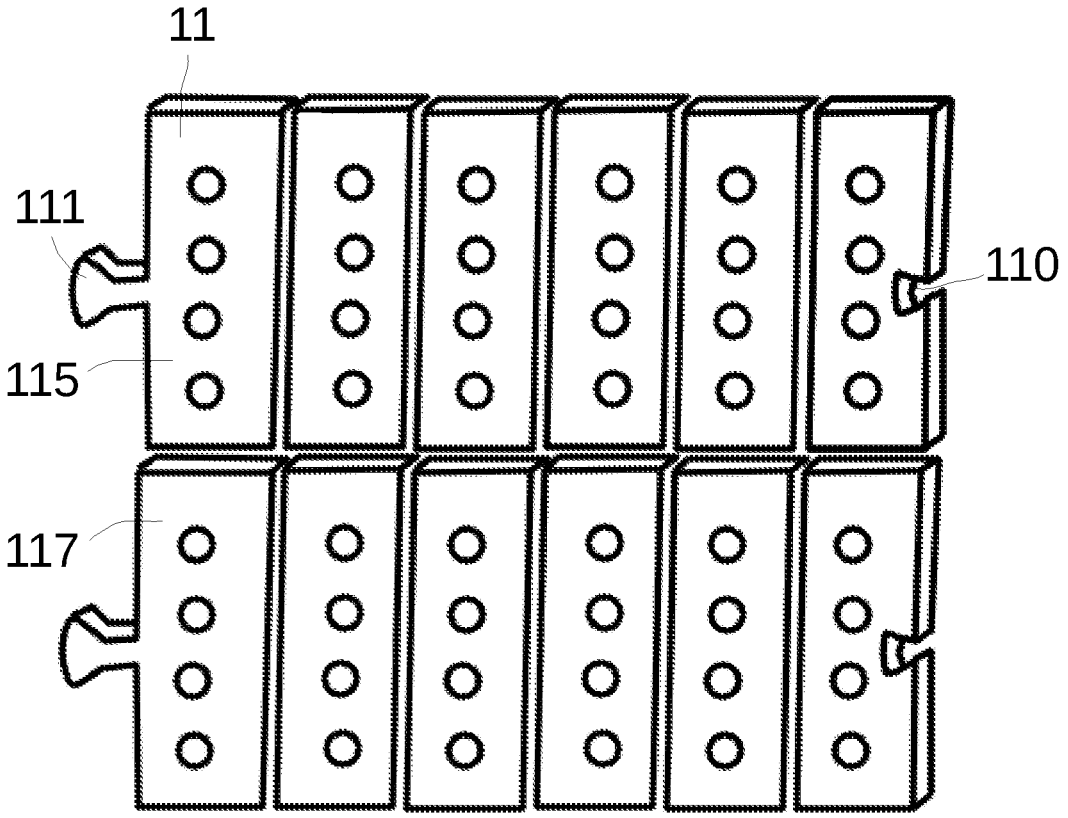
FIG. 1 illustrates an example of a bendable light bar module.

Please refer to FIG. 1. FIG. 1 illustrates an example of a bendable light bar module. In FIG. 1, the light bar module includes a plurality of light bars. In this embodiment, the light bar 11 includes two light bar sections 115 and 117. On both sides of the light bar module include corresponding buckles 111 and 110, so that the light bar is able to be folded to assemble to a three-dimensional cylindrical structure. A plurality of light emitting dies, such as light emitting diodes (LED), may be disposed on the light bar.

Figure 2A:
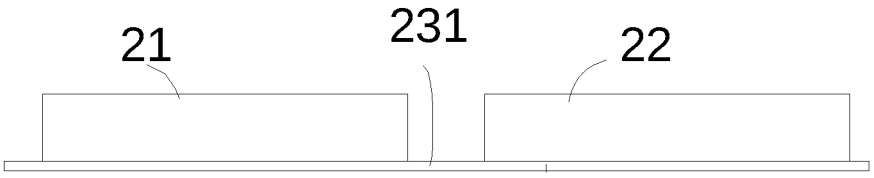
FIG. 2A and FIG. 2B each illustrates an example of a bendable light bar module.
Figure 2B:
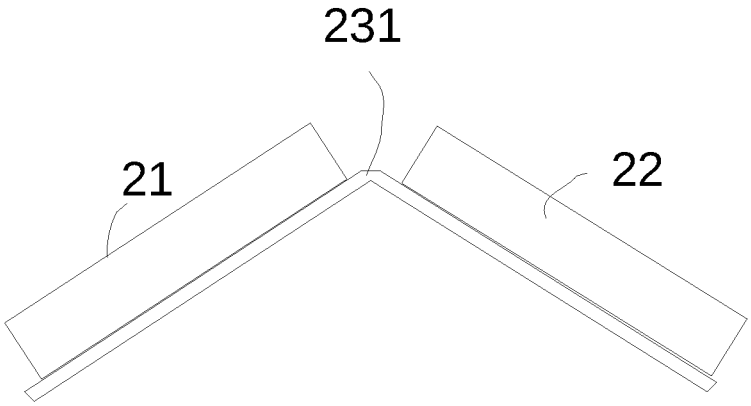

Please refer to FIG. 2A and FIG. 2B. FIG. 2A and FIG. 2B each illustrates an example of a bendable light bar module. In this side view, the light bar has two light bar sections 21 and 22. There is a segmented portion 231 between the two light bar sections. The segmented portion 231 may be bent and deformed by an external force, such as an expansion structure.

FIG. 2A shows the shape of the light bar before deformation, while FIG. 2B shows the shape of the light bar after deformation.

In other words, according to one embodiment, each of the light emitting diode light bars may include two or more light bar sections. A segmented portion is disposed between the light bar sections. When the light bar module is bent to deform by being abutted by the expansion structure, the light emitting diode light bars are bent in the segmented portion.

For example, the light bar may be divided into two sections, and a structure that is relatively easy to bend is provided between the two sections. Alternatively, suitable light emitting diode dies may be disposed on the two sections, and no structure is provided at the junction of the two sections. When the substrate itself is resilient, for example, aluminum is used as a material; applying bending force to the light bars may naturally bend the substrate at the junction of the two sections.

In addition, in one embodiment, the segmented portion retains its original shape when undergo no force, by designated materials or structures. In other words, if the segment is originally flat, the flat state remains when no force applied. However, if the segmented portion is bent by an external force, it remains in a bent state when the external force is in contact and does not continue to undertake other forces.

In one embodiment, the light emitting diode light bars includes a flexible circuit board as substrate. The substrate is bendable when undertaking a certain external force, while the substrate remains the shape when the external force is removed.

Figure 3:
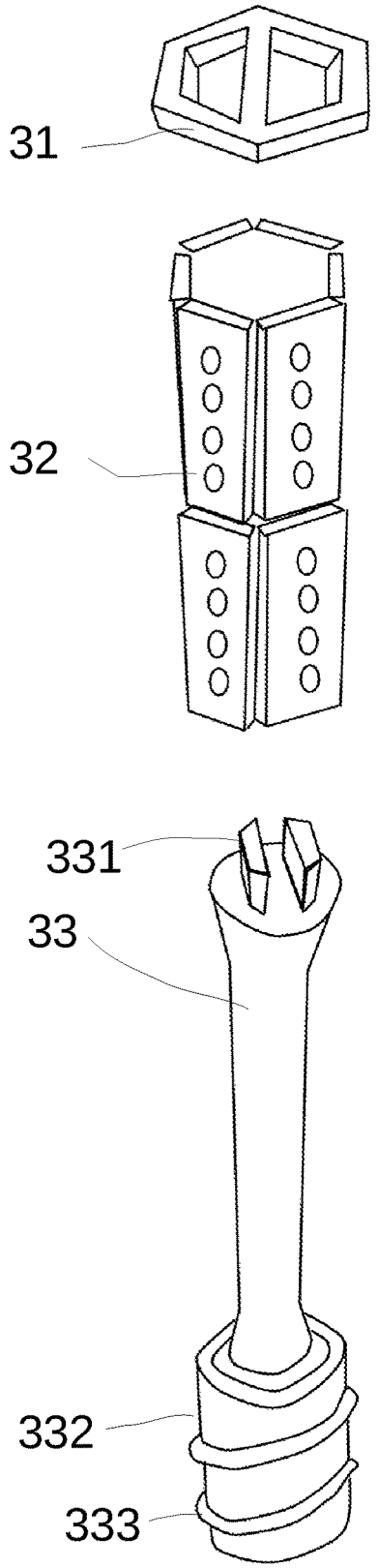
FIG. 3 illustrates a bendable light bar module and its corresponding elements.

Please refer to FIG. 3. FIG. 3 illustrates a bendable light bar module and its corresponding elements.

In FIG. 3, a light bar module 32 is formed by folding the light bar module of FIG. 1. The middle of the light bar module includes a pin hole, allowing a core stem 33 to be inserted. The core stem 33 includes a projection 331 at the top portion, so as to be fixed to a corresponding hole of a cap 31. The fixation may be ensured by further applying adhesives or welding.

A base 332 of the core stem 33 is designed corresponding to the neck of the bulb shell, and a corresponding threaded projection 333 is further applied.

Figure 4:
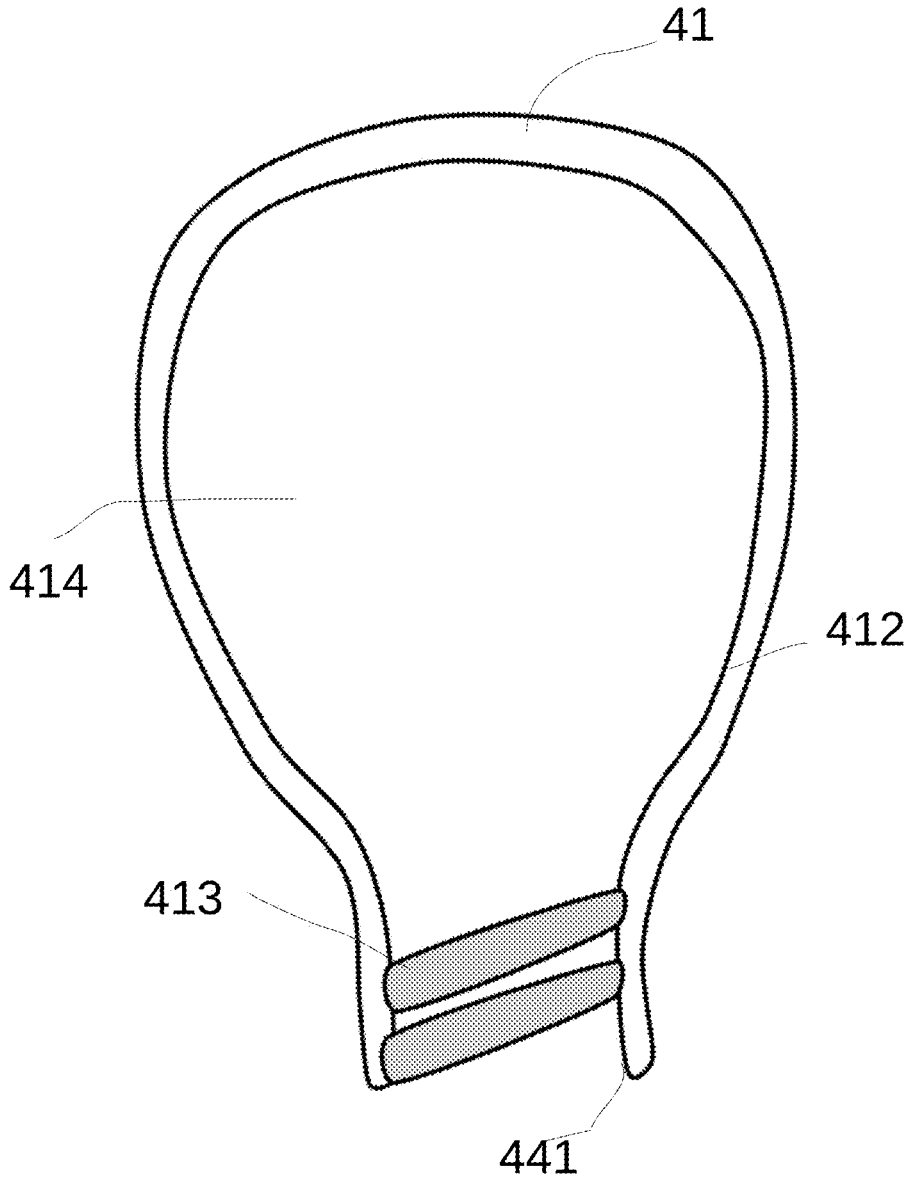
FIG. 4 illustrates a schematic diagram of a bulb shell.

Please refer to FIG. 4. FIG. 4 illustrates a schematic diagram of a bulb shell. This is a side view of a bulb shell 41. The bulb shell 41 includes a bulb body portion 412 having relatively large perimeter, and a neck portion 441 having relatively small perimeter. The neck portion 441 may further include threaded grooves 413 corresponding to the threaded projections of the core stem structure in FIG. 3. As described above, the light bar module 32 in FIG. 3 may pass through the relatively narrow neck portion 441 before expansion. After the light bar module 32 reaches an inner portion 414 of the bulb shell 41, it is deformable by the expansion structure.

Figure 5A:
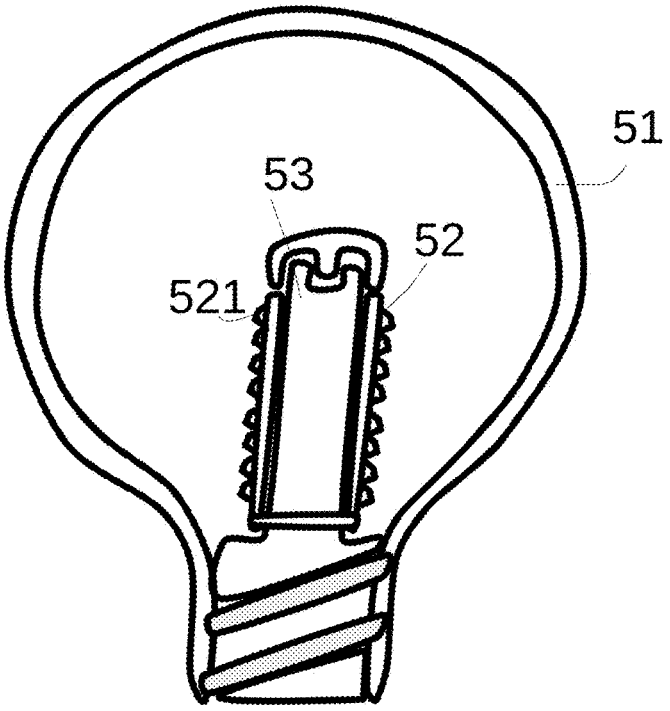
FIG. 5A and FIG. 5B illustrate a schematic diagram of the light bar module before and after expansion respectively.
Figure 5B:
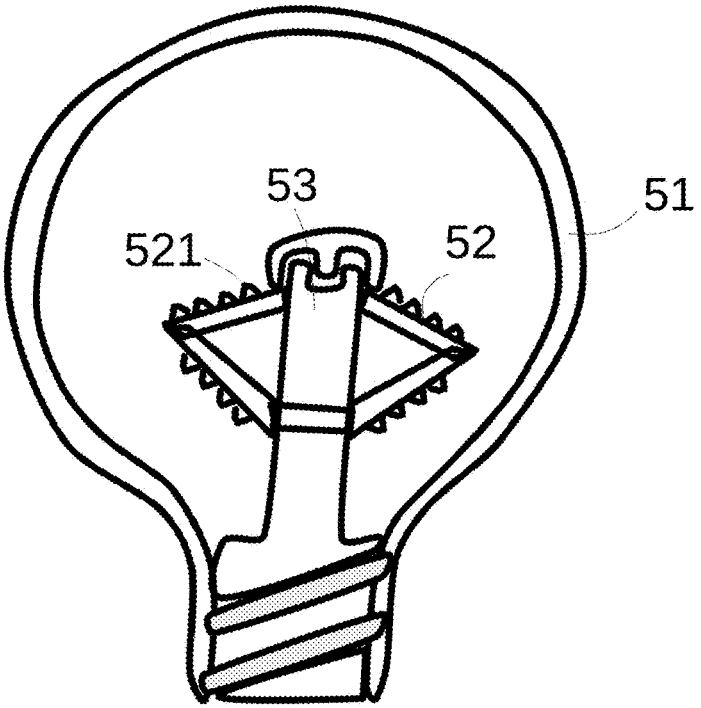

Please refer to FIG. 5A and FIG. 5B. FIG. 5A and FIG. 5B illustrate a schematic diagram of the light bar module before and after expansion respectively. Here are two schematic side views. After a light bar module 52 similar to that of the embodiment in FIG. 3 is inserted into the accommodating space of a bulb shell 51, the light bar module 52 may be pushed by a cannula (not shown) inside or on the surface of a core stem 53. The core stem includes a cap on the top portion, so as to hold one end of the light bar module 52. If the light bar includes two light bar sections as shown in FIG. 1 and is bendable at the segmented portion, the light bar is expanded to deform as shown in FIG. 5B. The light emitting dies 521 on the light bar are deformed with respect to the expansion and deformation of the light bar, by adjusting the angle and position of light emission.

Figure 8:
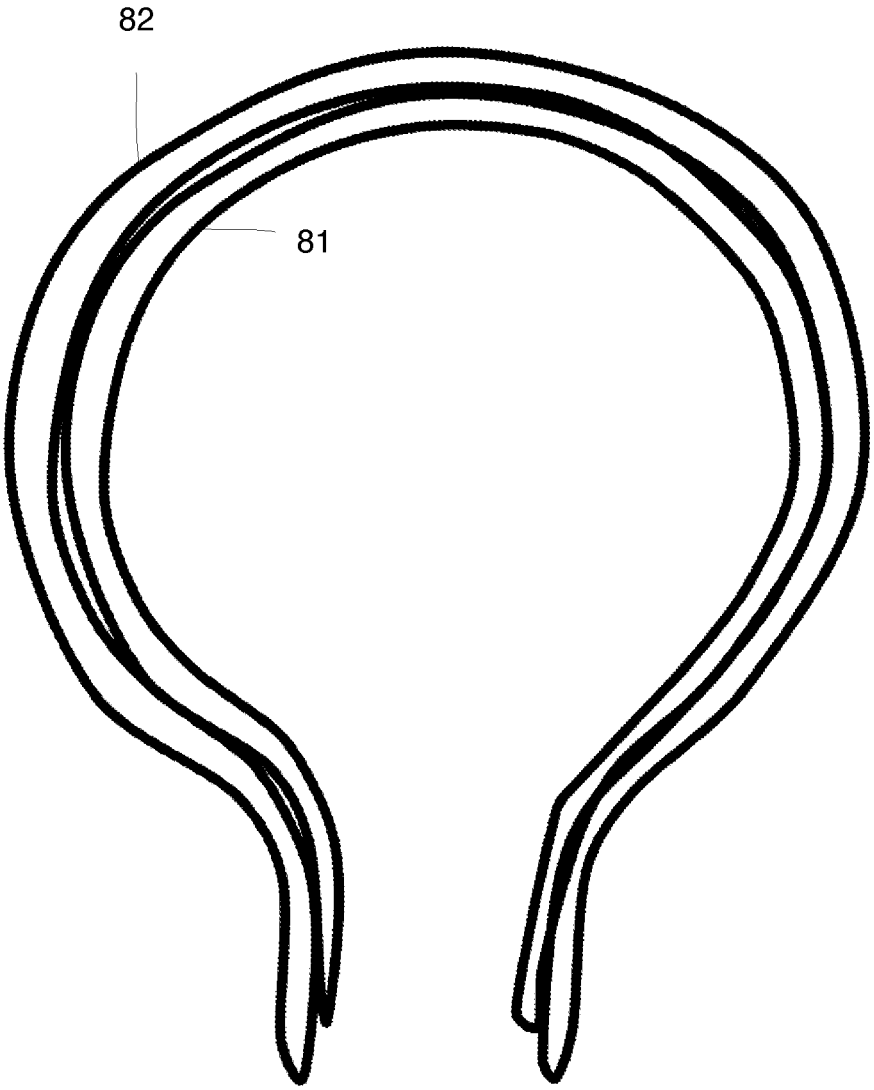
FIG. 8 illustrates another embodiment.

This is another possible embodiment. Please refer to FIG. 8. FIG. 8 illustrates another embodiment. In FIG. 8, a light bar 81 is partially or completely attached to the inner side of a bulb shell 82, by utilizing an airbag or other expansion structures.

In this kind of embodiments, adhesives may be applied to a predetermined location of the light emitting diode light bars. Therefore, when the light emitting diode light bars are abutted by the expansion structure so that it touches the bulb shell, the adhesives stick to the bulb shell, in order to generate a certain fixing effect between the light-emitting diode light bar and the bulb shell. In other words, the light bar is partially or completely attached to the bulb shell. By doing this, not only the lighting efficiency is higher, the relative distance of the light emitting dies is also farther. Therefore, either heat dissipation issues are relieved, or more light emitting dies or other more efficient light emitting dies are allowed to be put into the light bar. In one embodiment, a corresponding snap structure may be formed on the inner side of the bulb shell with the light emitting diode light bar.

When the inner side of the bulb shell is in contact with the light emitting diode light bar, the inner side of the bulb shell is engaged with the light emitting diode light bar through the corresponding snap structure. This is an alternative to the adhesives. In addition, the method may further include a step of connecting the light bar module with a driving circuit.

In addition, multiple light emitting diode light bars of the light bar module may be designed to be connected at the top portions. This design makes it easier to install the light bar module into the bulb shell.

In one embodiment, the method may further include a step of placing a heat dissipation element on the back of the light emitting diode light bars facing the bulb shell. For example, a thermal conductive plate may be placed, so as to transmit a part of the heat to other portions of the bulb to dissipate heat. A cooling fin or other designs, such as a liquid cooling circulation tube, may also be disposed in the bulb, in order to facilitate heat dissipation. In one embodiment, more than one light emitting module may be installed into the bulb shell. In other words, this method may include another step of installing another light emitting module into the bulb shell. This other light emitting module is surrounded by multiple light emitting diode light bars.

According to another embodiment of the present invention, a bulb apparatus including a bulb shell, a light bar module, a driving circuit and a bulb cap is provided. The light bar module is installed in the bulb shell. The light bar module includes a plurality of light emitting diode light bars. These light emitting diode light bars are individually expanded toward the inner surface of the bulb shell. A driving circuit is connected to the light bar module. The bulb cap includes two electrical connection terminals for connecting external power to the driving circuit, so as to allow the driving circuit to drive the light bar module to generate illumination. In one embodiment, at least a portion of multiple light emitting diode light bars contacts the bulb shell. In addition, in another embodiment, the light emitting diode light bars may include two or more light bar sections. A segmented portion is disposed between the light bar sections. When multiple light emitting diode light bars are expanded outward by an expansion structure, multiple light emitting diode light bars are individually expanded toward the inner surface of the bulb shell. When the expansion force is removed, the light emitting diode light bars continue to maintain the shape. The substrate of each of the light emitting diode light bars may be a flexible circuit board, which may be bent when subjected to a certain external force, but continues to retain the shape after the external force is removed. The light emitting diode light bars may include adhesives at a predetermined location. The light emitting diode light bar and the bulb shell are fixed through the adhesive. A corresponding snap structure may be further included on the bulb shell and the light emitting diode light bars. So the bulb shell and the light emitting diode light bars are engaged through the corresponding snap structure. In addition, multiple light emitting diode light bars of the light bar module may be connected together at the top portion. A heat dissipation element may be further disposed on the back of the light emitting diode light bars, relative to the bulb shell. The bulb apparatus may further include another light emitting module located among multiple light emitting diode light bars. The light bar module may include two or more sub-light bar modules, each of which has a plurality of light emitting diode light bars. According to another embodiment of the present invention, a light apparatus including a light transmitting bulb shell, a light bar module and a power supply circuit is provided. The light bar module is installed inside the light transmitting bulb shell. The light bar module includes a plurality of light emitting diode light bars, wherein at least a portion of the light emitting diode light bars abuts the light transmitting bulb shell. The power supply circuit connects to the light bar module and supplies electric power required for the light bar module. In other words, in addition to the bulbs hanging on the ceiling, this design concept may also be used in a variety of general light apparatus with different shapes. The light emitting diode light bars may be attached to the light transmitting bulb shell through the above method, so as to further increase the heat dispensation and lighting efficiency. The light transmitting bulb shell may be in a variety of shapes. The power supply circuit may also be a battery, and is not necessarily connected to an internal power supply.

In addition, the light emitting diode light bar may have two or more light bar sections. A segmented portion is disposed between the light bar section. When the light emitting diode light bars are abutted by an expansion structure and expand outwards, each of the light emitting diode light bars may be individually deformed and expanded toward the inner surface of the light transmitting bulb shell. When the expansion force is removed, multiple light emitting diode light bars continuing to maintain the shape at that time. In addition, the substrate of each of the light emitting diode light bars may be a flexible circuit board. It may be bent when undertaking a certain external force, but continue to retain the shape after the external force is removed. In addition, the light emitting diode light bars may include adhesives at a predetermined position, so as to generate a certain fixing effect between the light emitting diode light bars and the light transmitting bulb shell. In addition, the light apparatus may have a snap structure corresponding to the light transmitting bulb shell and the light emitting diode light bar, so as to snap the light transmitting bulb shell and the light emitting diode light bars.

In addition, multiple light emitting diode light bars of the light bar module may be designed to be connected together at their top portions. A heat dissipation element may be further included on the back of the light emitting diode light bars, relative to the bulb shell.

Although the present invention has been described in relation to particular embodiments thereof, multiple other variations and modifications and other uses may become apparent to those skilled in the art. A simple substitution or elimination of element has to fall within the scope of the present invention.

The invention claimed is:

1. A bulb apparatus, comprising:

a bulb shell;

a core stem;

a light bar module installed in the bulb shell, the light bar module comprising a plurality of light emitting diode (LED) light bars, each LED light bar comprising multiple light bar sections, each light bar section comprises multiple LED modules, each LED light bar being individually expanded toward an inner surface of the bulb shell, top ends of the plurality of LED light bars are fixed to a top of the core stem, bottom ends of the plurality of LED light bar being connected and surrounding the core stem, when the plurality of LED light bars being bent to expand toward the inner surface of the bulb shell, the tops ends of the plurality of LED light bars being kept fixed to the top of the core stem while the bottom ends of the plurality of LED light bars being moved surrounding and along the core stem, and each LED light bar being folded at a connection part between two light bar sections of each LED light bar;

a driving circuit connecting to the light bar module; and a bulb cap supporting the core stem, the bulb cap having two electrical connection terminals for connecting external power to the driving circuit so as to allow the driving circuit to drive the light bar module to generate illumination.

2. The bulb apparatus of claim 1, wherein the light emitting diode light bars comprises two or more light bar sections, and a segmented portion is disposed between the light bar sections when the expansion structure abuts the light emitting diode light bars and are expanded outward, the light emitting diode light bars are individually expanded and deformed toward the inner surface of of the bulb shell when the expansion force is removed, the plurality of light emitting diode light bars continue to maintain original shapes of the plurality of light emitting diode light bars.

3. The bulb apparatus of claim 2, wherein the light emitting diode light bars each comprises a flexible circuit board as substrate, the substrate is bendable when undertaking a certain external force while the substrate remains the shape when the external force is removed.

4. The bulb apparatus of claim 1, wherein each of the light emitting diode light bars facing the bulb shell comprises a heat dissipation element on a back side of the light emitting light bars.

5. The bulb apparatus of claim 1, further comprising another light emitting module located among the plurality of light emitting diode light bars.

6. The bulb apparatus of claim 1, wherein the light bar module comprises two or more sub-light bar modules, and each sub-light bar module comprises a plurality of light emitting diode light bars.

* * * * *